United States Patent [19]

Fogleman, Sr.

[11] Patent Number: 5,045,648

[45] Date of Patent: Sep. 3, 1991

[54] LOCKING ROCKER SWITCH

[75] Inventor: Eric W. Fogleman, Sr., Four Oaks, N.C.

[73] Assignee: Eaton Corporation, Cleveland, Ohio

[21] Appl. No.: 498,237

[22] Filed: Mar. 23, 1990

[51] Int. Cl.[5] ..... H01H 9/20

[52] U.S. Cl. ..... 200/43.16; 200/325; 200/339

[58] Field of Search ..... 200/43.01, 43.04, 43.16, 200/43.17, 321, 322, 323, 324, 325, 332, 335, 339, 433, 437, 556, 43.18, 43.19, 333, 345

[56] References Cited

U.S. PATENT DOCUMENTS

| | | | |
|---|---|---|---|
| 1,656,952 | 1/1928 | Nutt | 200/345 |
| 1,687,165 | 10/1928 | Leppert | 200/304 |
| 2,141,936 | 12/1938 | Schmitt | 200/304 |
| 2,248,362 | 7/1941 | Krieger | 200/68 |
| 2,348,393 | 5/1944 | Krieger | 200/334 |
| 2,723,571 | 11/1955 | Koenig | 74/528 |
| 2,824,915 | 2/1958 | Buturuga | 200/43.16 |
| 2,885,905 | 5/1959 | Larkin | 74/536 |
| 3,603,755 | 9/1971 | Ranzanigo | 200/345 |
| 3,833,784 | 9/1974 | Bobel et al. | 200/43.17 |
| 4,002,874 | 1/1977 | Brown | 200/321 |
| 4,006,334 | 2/1977 | Robotham et al. | 200/43.17 |
| 4,013,858 | 3/1977 | Grebner et al. | 200/43.04 |
| 4,160,136 | 7/1979 | McGough | 200/345 |
| 4,168,416 | 9/1979 | Josemans | 200/43.04 |
| 4,174,472 | 11/1979 | Josemans | 200/437 |
| 4,291,207 | 9/1981 | Reinke et al. | 200/43.04 |
| 4,440,994 | 4/1984 | Nat | 200/43.04 |
| 4,767,895 | 8/1988 | Parrish | 200/43.04 |
| 4,870,230 | 9/1989 | Osika et al. | 200/6 R |
| 4,947,009 | 8/1990 | Osika et al. | 200/43.16 |

FOREIGN PATENT DOCUMENTS

| | | | |
|---|---|---|---|
| 1947014 | 3/1971 | Fed. Rep. of Germany | 200/321 |

*Primary Examiner*—Henry J. Recla
*Assistant Examiner*—Glenn T. Barrett
*Attorney, Agent, or Firm*—L. G. Vande Zande

[57] ABSTRACT

A lock having depending sides with holes therein is snap fit attached to a rocker actuator by causing the sides to straddle the actuator and the holes to receive beveled lateral tabs on the actuator, the holes being longer than the tabs to permit and define sliding movement of the lock on the actuator. Four feet depend from the depending sides of the lock within a housing opening in which the actuator is pivotally mounted to abuttingly align with corresponding abutments in the housing on opposite sides of the pivotal axis of the actuator, preventing rotational movement of the actuator when the lock is in a first position with respect thereto under the bias of a compression spring. The actuator is released by sliding the lock against the bias of the spring to move the feet radially offset from the abutments, thereby permitting rotational movement of the actuator in either direction, actuating corresponding switch contacts.

9 Claims, 4 Drawing Sheets

LOCKING ROCKER SWITCH

BACKGROUND OF THE INVENTION

This invention relates to switches which automatically lock when in the off position and require a special manipulation of the switch operator to release the lock and operate the switch. In particular, this invention relates to switches of the aforementioned type having a rocking actuator/operator assembly operable in a double throw mode.

Switches which are provided with a lock-off means that requires a distinct manipulation of the operator to release the lock are well known. Toggle switches have been provided with levers that must be pulled or pushed to release a lock prior to pivoting the lever for switch operation. Toggle switches are also known which have a guard member pivotally mounted over the lever, requiring the guard to be first lifted in order to operate the toggle lever. In the on position, the toggle lever maintains the guard displaced from a normal position. The switch may be operated to the off position by moving the guard back to the original position. Rocker switches are known which have key elements removable from the rocker button assembly to lock the switch in the off position. The key must be in place before the switch can be operated to an on condition. A variation of the removable key rocker switch maintains the key with the switch, but biases the key to a locking position, requiring that the key be depressed to unlock the rocker button assembly prior to operating the switch to an on position. Rocker switches are also known which have a locking member slidably carried on the rocker button assembly, the slide member being spring biased to a locking position and slidable against the spring bias to an unlocked position. A majority of the switches of the foregoing type are single throw or full throw switches. No known rocker switch and few toggle switches provide a double throw lock-off switch wherein the off position of the lever or rocker operator is centered between opposite on positions. Due to stark contrasts in appearance between toggle and rocker switches, use of a toggle switch to obtain the off-lock double throw function is aesthetically unacceptable in many applications.

SUMMARY OF THE INVENTION

This invention provides a locking rocker switch wherein a lock member is slidably attached to a rocking actuator for movement against the bias of a spring from a first position to a second position to release the lock. The intercooperation of elements to provide the lock function occurs within the housing of the switch. The lock function is usable in either single throw or double throw operator embodiments. These features and advantages of this invention will become readily apparent when reading the following description and appended claims in conjunction with the accompanying drawings.

DETAILED DESCRIPTION OF THE PREFERRED EMBODIMENTS

Figure 2:
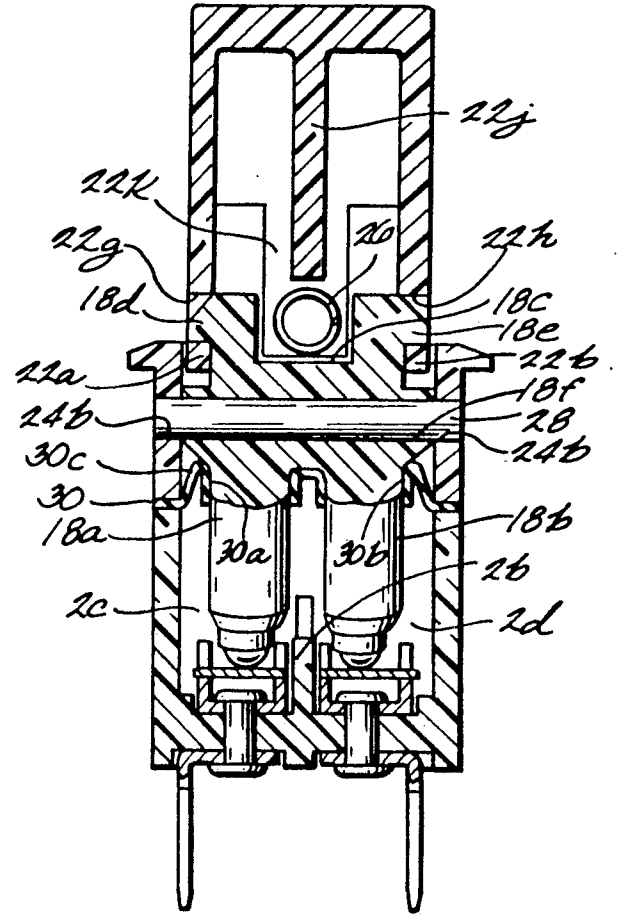
FIG. 2 is a cross sectional view of the switch of FIG. 1 taken along the line 2—2 in FIG. 1.

FIGS. 1-6 of the drawings illustrate a double pole, single throw rocker switch having an off-lock mechanism constructed in accordance with this invention. The switch mechanism is essentially that shown and described in U.S. Pat. No. 2,248,362 issued July 8, 1941 to A. W. Krieger. Generally, it comprises a molded insulating base 2 having a hollow interior cavity **2*a* divided by barrier 2*b* into pockets 2*c* and 2*d* (FIG. 2). Each pocket has a U-shaped stationary contact 4 positioned within a central recess in the bottom of the respective pocket 2*c*, 2*d*. A terminal 6 is secured against the external surface of base 2 in alignment with a respective contact 4 by a rivet 8 which passes through aligned holes in the base 2, contact 4 and terminal 6 and is riveted over the terminal 6. A second rivet 10 extends through a hole in base 2 at the right-hand end of the respective switch pockets 2*c*, 2*d* as viewed in FIG. 1, to project through an aligned hole in a terminal 12 positioned against the external surface of base 2 and is riveted over to secure terminal 12 to base 2. The head end 10*a* of rivet 10 functions as a stationary contact for the switch within the respective pocket. A rocking contactor blade 14 is pivotally mounted at its center in the U-shaped stationary contact 4 for teeter-totter-like movement thereabout. Stationary contacts 4 and 10*a* and rocking contacter blade 14 within a respective pocket 2*c* or 2*d*** constitute one pole of the switch.

A plunger 16 carried by a pivoted actuator 18 is biased against an upper surface of movable contactor blade 14 by a spring 20. Pivotal movement of actuator 18 carries plunger 16 back and forth across the pivot of stationary contact 4 to move a movable contact element **14*a* riveted to one end of contactor blade 14 into and out of engagement with stationary contact 10*a*. The switch base 2** and contact elements constitute a first major subassembly of the switch of this invention.

Actuator 18, SPRING 26 and a lock 22 are assembled together and then pivotally mounted to a housing frame member 24 to constitute the other major subassembly of the switch of this invention. Actuator 18 comprises a T-shaped member as viewed in FIGS. 1 and 4 having two depending substantially vertical legs **18*a* and 18*b* as seen in FIG. 2, extending into respective switch pockets 2*c* and 2*d*. The upper surface of the cross bar of actuator 18 is formed at an angle to the general plane of the cross bar and has a recess 18*c* therein. A pair of lateral tabs 18*d*, 18*e* (FIGS. 2 and 4) extend outwardly from opposite sides of the cross bar of actuator 18 near the upper surface thereof. The upper corners of tabs 18***d*, 18*e* are beveled to facilitate snap fit attachment of lock 22 onto actuator 18.

Figure 1:
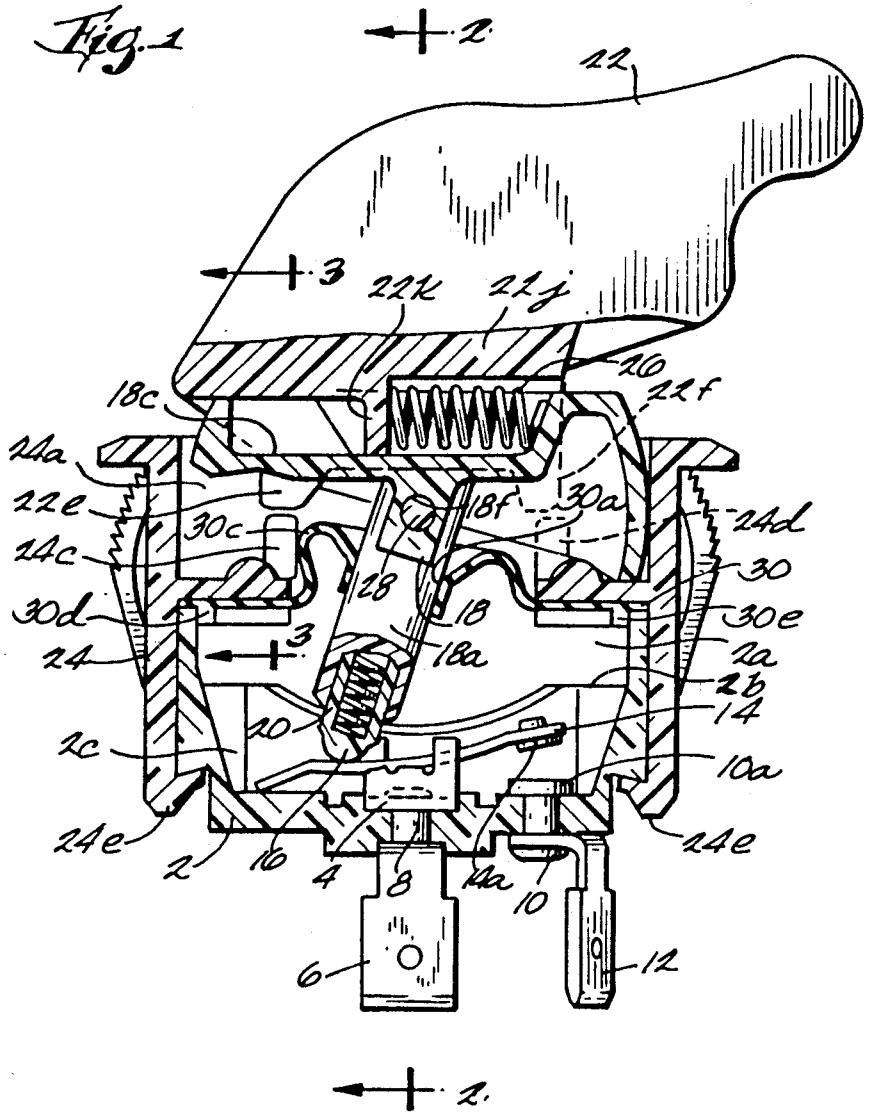
FIG. 1 is a cross sectional view of a single throw locking rocker switch constructed in accordance with this invention.

Lock 22 is essentially a hollow molded plastic member having depending extensions 22*a*, 22*b* of the respective opposite sides, the extension 22*a* having a pair of feet 22*c* and 22*d* depending therefrom at opposite ends. Depending extension 22*b* has feet 22*e*, 22*f* (corresponding to feet 22*c*, 22*d*, respectively) depending therefrom at opposite ends. Within the depending extensions 22*a*, 22*b* are rectangular apertures 22*g*, 22*h* which snap over and receive the lateral tabs 18*d*, 18*e*, respectively, when lock 22 is pressed onto the actuator 18. Apertures 22*g*, 22*h* are longer in a direction transverse to a pivot axis of actuator 18 (to be described later) than is the length of lateral tabs 18*d*, 18*e*, thereby permitting sliding movement of lock 22 on actuator 18. As seen in FIGS. 1 and 2, a helical compression spring 26 is positioned within recess 18*c* of actuator 18 and is maintained therein by an overlying central rib 22*j* of lock 22. Another rib 22*k*, oriented transversely with respect to rib 22*j*, provides an abutment for an opposite end of spring 26. It will be appreciated that spring 26 acting between the right-hand end of recess 18*c* and transverse rib 22*k*, maintains lock 22 biased to a left position on actuator 18, such position defined by engagement of the right-hand end of apertures 22*g*, 22*h* with the corresponding ends of lateral tabs 18*d*, 18*e*.

Figure 3:
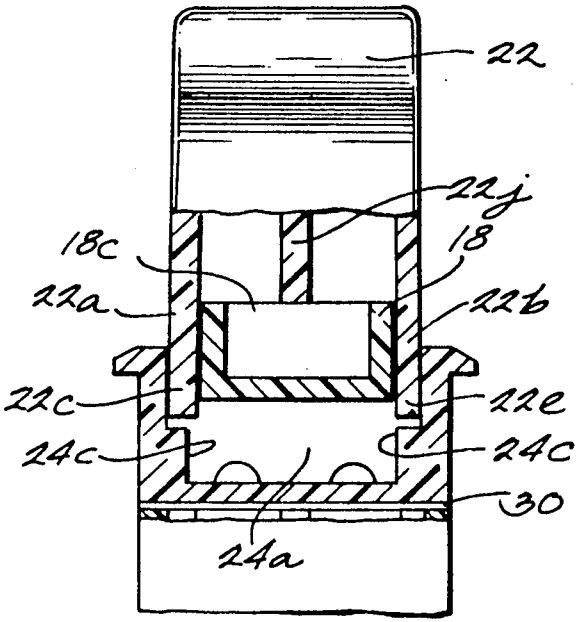
FIG. 3 is a partial sectional view taken substantially along the line 3—3 in FIG. 1.
Figure 4:
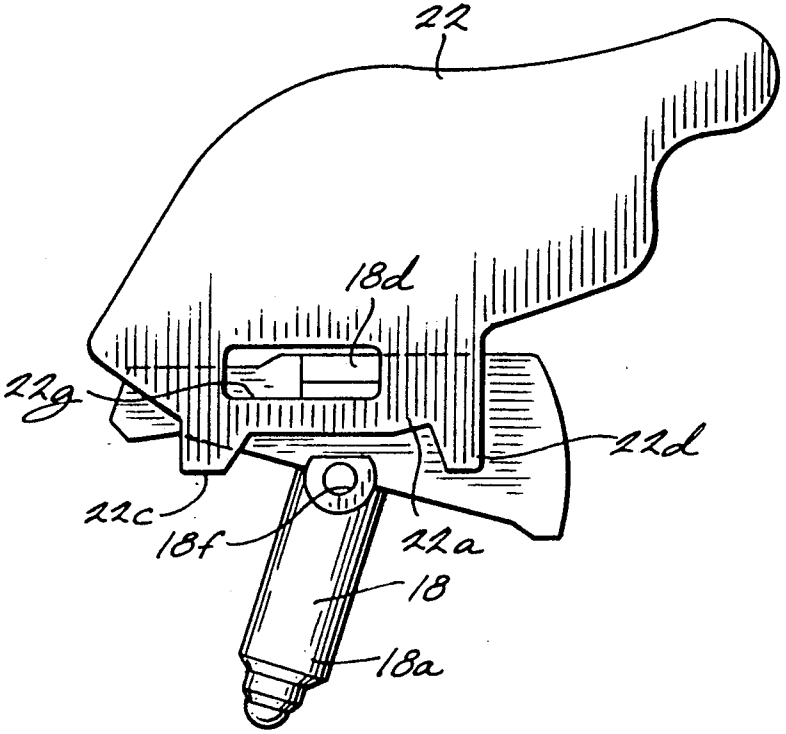
FIG. 4 is a side elevational view of a lock and rocker actuator subassembly of the switch of FIGS. 1-6.
Figure 6:
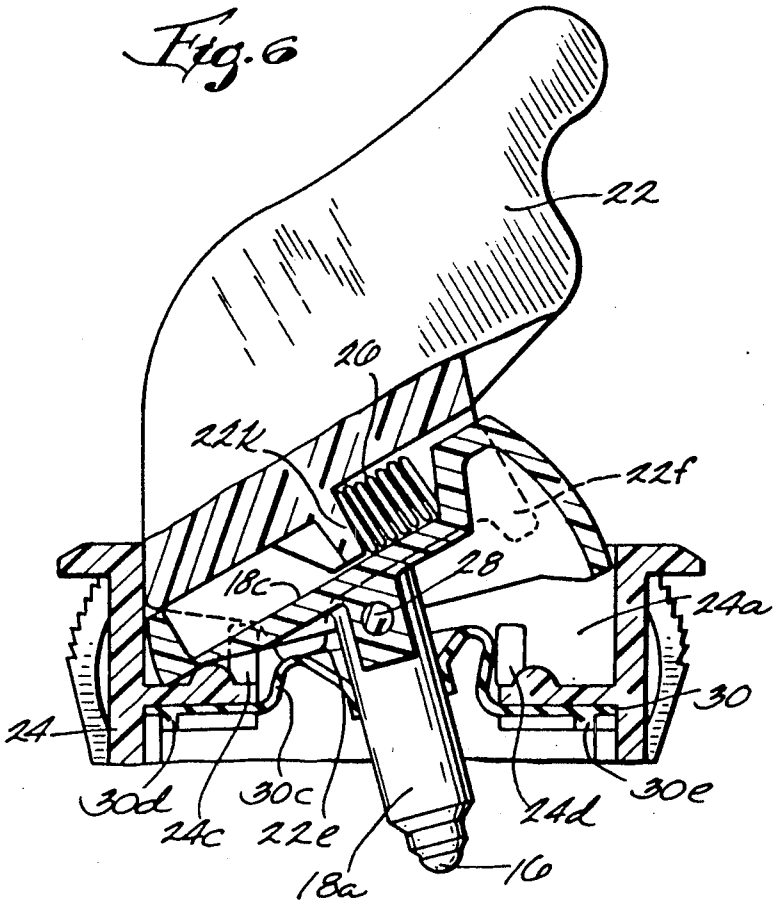
FIG. 6 is a view similar to FIG. 5 but showing the lock and rocker actuator operated to an on position of the switch.

The actuator 18/lock 22 subassembly is pivotally mounted within a open cavity 24*a* of frame 24 by a pin 28 which is inserted through aligned openings 24*b* in the respective opposite side walls of frame 24 and hole 18*f* extending through actuator 18 at the juncture of the upper cross bar and the depending vertical legs. The depending extensions 22*a*, 22*b* of the opposite sides of lock 22 extend into the housing opening comprising frame cavity 24*a* closely spaced between the opposite sides of actuator 18 and the opposite side walls of frame 24 in which the ends of pin 28 are mounted. The same side walls of frame 24 have abutments 24*c*, 24*d* formed thereon, projecting inwardly toward respective corresponding opposite abutments. As seen in FIG. 3, the abutments project inwardly approximately the thickness of side extensions 22*a*, 22*b* of lock 22. As seen in FIG. 1, the depending feet 22*e*, 22*f*, and corresponding feet 22*c*, 22*d*, are aligned in abutting relating with corresponding abutments 24*c*, 24*d* when lock 22 is in its left position with respect to actuator 18.

A rubber seal 30 is disposed over actuator 18 from the lower side of frame 24. Seal 30 has a pair of leg openings 30*a*, 30*b* for receiving the respective legs 18*a*, 18*b* of actuator 18. Legs 30*a*, 30*b* are formed in a raised central boot portion 30*c*. A pair of depending U-shaped ribs 30*d*, 30*e* are provided at the opposite ends of the otherwise planar seal 30. The two major subassemblies are brought together by placing frame 24 over the open side of base 2, positioning the actuator legs 18*a*, 18*b* into the respective switch pole pockets 2*c*, 2*d*. The planar portion of seal 30 overlies the peripheral upper rim of base 2 surrounding the cavity 2*a*, the U-shaped ribs 30*d*, 30*e* projecting into the cavity 2*a*. The base 2 and frame 24 are locked together by hooks 24*e* formed at the distal ends of depending flexible legs at the opposite ends of frame 24. The legs and hooks 24*e* are deflected outwardly along the ends of base 2 as the two members 2 and 24 are brought together, and snap over overhanging ledges at the bottom of base 2 when the base is fully seated within the frame 24.

Figure 5:
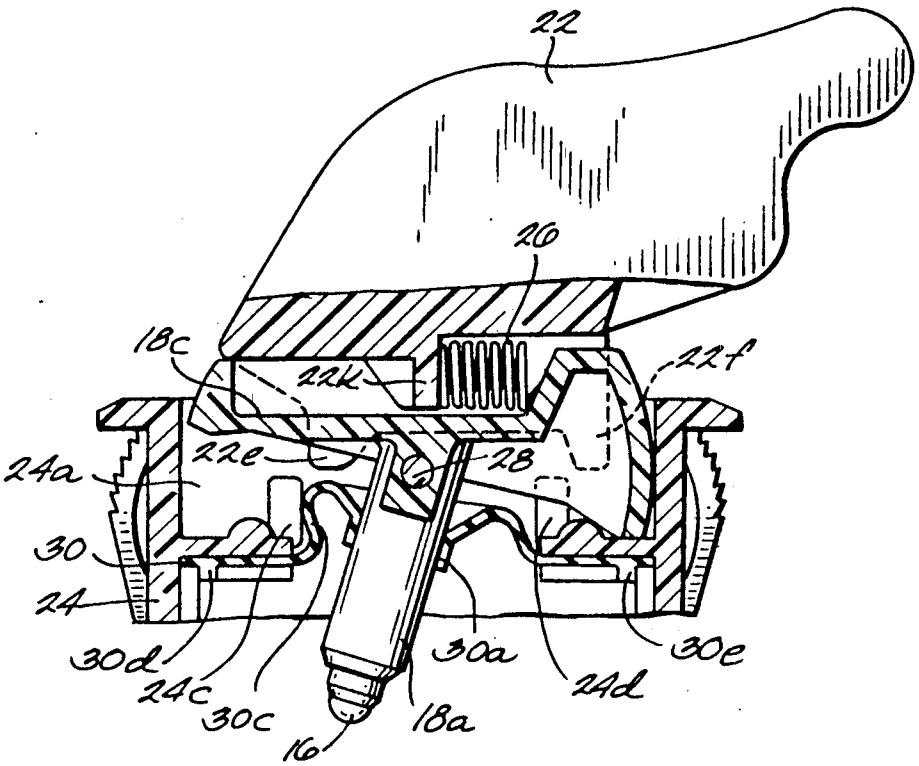
FIG. 5 is a fragmentary view of the switch of FIG. 1 showing the lock member displaced to an unlocking position.

The switch of FIGS. 1-6 is shown in its off position in FIG. 1 wherein actuator legs 18*a*, 18*b* and plungers 16 are disposed to the left of fulcrum contact 4, thereby rocking contactor 14 counterclockwise to separate contacts 14*a* and 10*a*. The near abutment position of the respective feet 22*c*–22*f* with corresponding abutments 24*c* and 24*d* prevent actuator 18 and lock 22 from being rotated either clockwise or counterclockwise. Referring to FIG. 5, the lock 22 is slid along the upper surface of actuator 18 to a right-hand position thereon, compressing spring 26. In this position, it can be seen that the foot 22*e* has moved to the right of abutment 24*c* and that the foot 22*f* has moved to the right of abutment 24*d*, as have corresponding feet 22*c* and 22*d* on the near side (not visible in FIG. 1) of the lock. In this right-hand position, feet 22*c*–22*f* are clear of abutting relation with the respective abutments 24*c* and 24*d* and the actuator 18 and lock 22 may be rotated as a unit either clockwise or counterclockwise. In the single throw switch shown in FIGS. 1-6, only counterclockwise movement is permitted because the right-hand end of the cross bar of actuator 18 is normally bottomed against the frame 24. Counterclockwise movement of the actuator 18/lock 22 carries plunger 16 across the fulcrum contact 4 to effect closure of movable contact 14*a* on stationary contact 10*a* in each pole. As may be also seen in FIG. 6, lock 22 is held in its right-hand position against the bias of spring 26 by engagement of the left end of lock 22 with the inner end wall of frame 24, but will return to its left-hand position when returned to the off position shown in FIG. 1.

Figure 8:
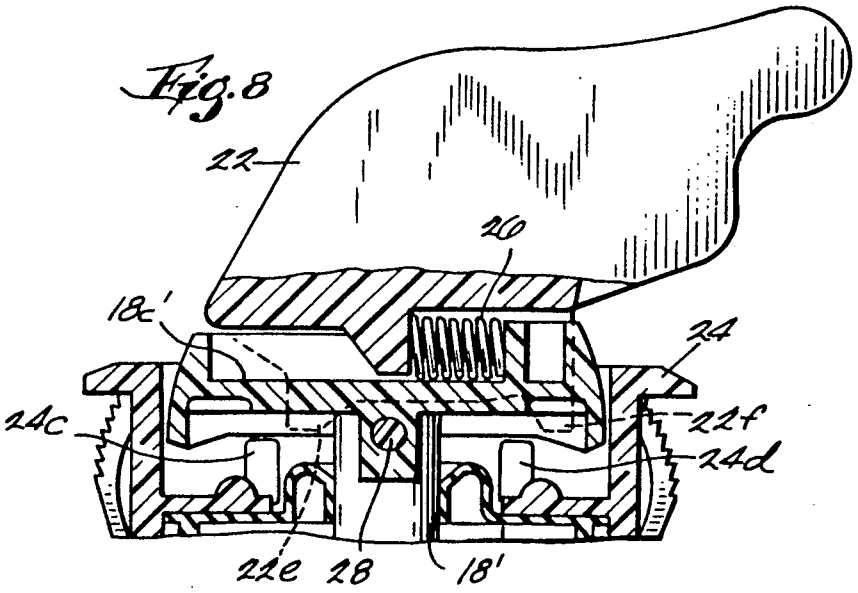
FIG. 8 is a fragmentary cross sectional view similar to FIG. 7 showing the lock displaced to an unlocking position.
Figure 9:
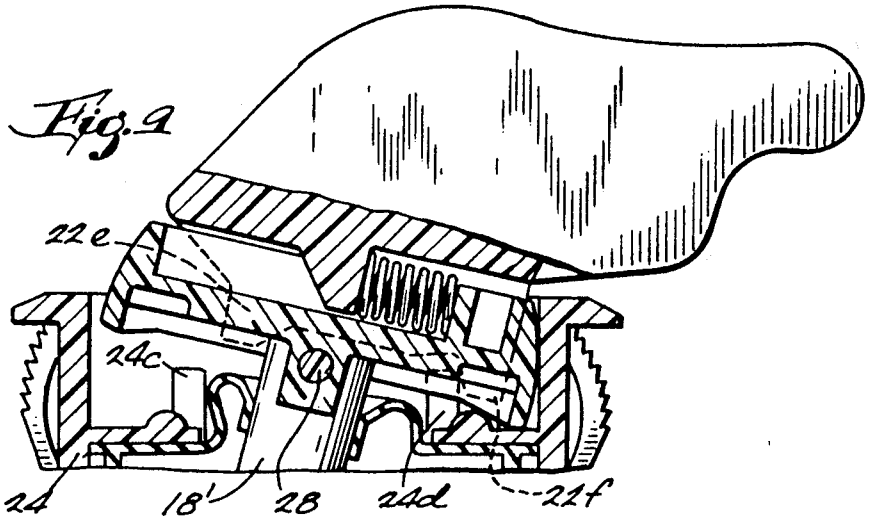
FIG. 9 is a view similar to FIG. 8 showing the lock and rocker actuator of the double pole switch operated to one of two on positions.
Figure 7:
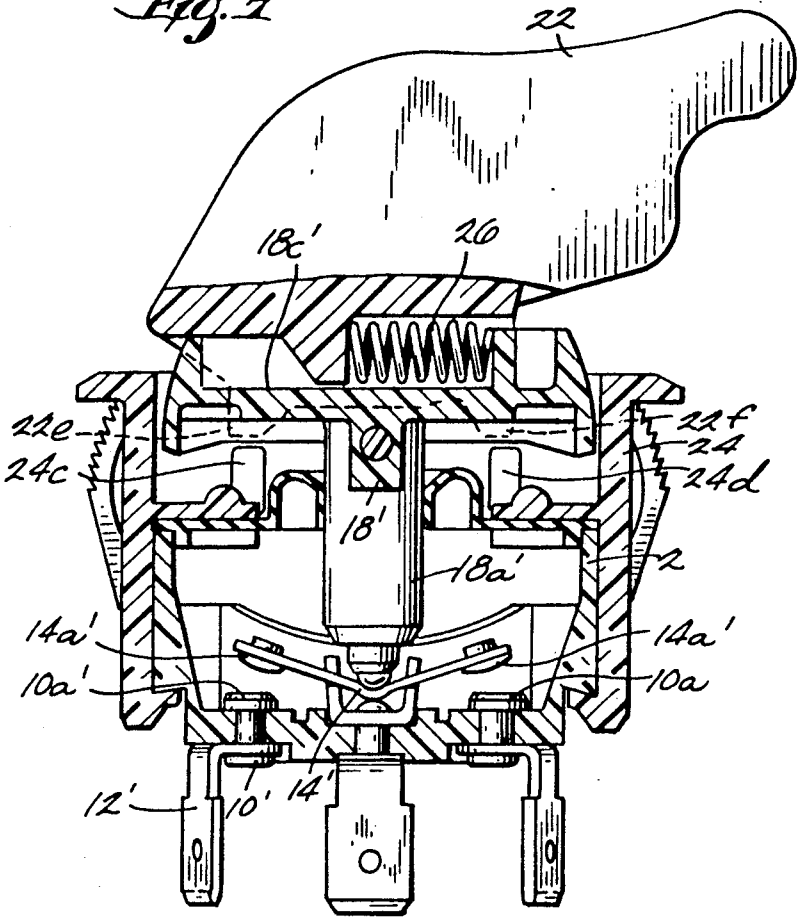
FIG. 7 is a cross sectional view similar to FIG. 1, but showing a double throw switch incorporating the lock-off feature of this invention.

A second embodiment of the switch this invention is illustrated in FIGS. 7-9. The switch shown therein is a double throw switch and is otherwise similar to the switch of FIGS. 1-6. Only the elements which are distinct from the switch of FIGS. 1-6 will be described in conjunction with FIGS. 7-9.

Referring to FIG. 7, a second rivet 10' is disposed within a hole in base 2 at the left-hand end of the respective switch pockets 2*c*, 2*d*. The rivet 10' extends through a hole in the bottom wall of base 2 and an aligned hole in an additional terminal 12, positioned against the external bottom surface of base 2 and is riveted thereover to secure the terminal and rivet to the base. The headed end of rivet 10' provides a stationary contact 10*a'* within the respective switch poles. Rocking contactor blade 14 is replaced with a shallow V-shaped rocking contactor blade 14' which has movable contact elements 14*a'* riveted thereto at opposite ends for engagement with the respective stationary contacts 10*a* and 10*a'*. Actuator 18' is essentially the same as actuator 18 except that the upper surface of the cross bar is not formed at an angle to the general plane of the cross bar, but instead is disposed essentially normal to the depending legs of the actuator. A recess 18*c'* is provided in the upper surface of the crossbar of actuator 18'.

As can be seen in FIG. 7, depending feet 22*e*, 22*f* (and corresponding feet 22*c*, 22*d*) of lock 22 are disposed in corresponding abutting alignment with the respective abutments 24*c*, 24*d* of frame 24, thereby locking the switch of FIG. 7 in the center off position. Sliding movement of the lock 22 to the right against the bias of spring 26 displaces the respective feet 22*c*–22*f* radially clear of the abutments 24*c*, 24*d* to permit rotation of the actuator 18' and lock 22 in either the counterclockwise direction as shown and described with respect to the single throw switch in FIG. 6, or clockwise as shown in FIG. 9. In the clockwise operated position of FIG. 9, the corresponding feet 22*d*, 22*f* abut the sides of abutments 24*d* within frame 24 to maintain the lock 22 in its right-hand position against the bias of spring 26. The switch can be operated to the off position merely by lifting upward on the right-hand end of lock 22, rotating the lock and actuator 18' counterclockwise to the center off position whereupon the feet 22*d*, 22*f* slide along the upper right-hand corner of abutments 24*d* until the lower edge of the respective feet clear the upper edge of the abutment, thereby permitting spring 26 to bias the lock 22 to its left-hand position as shown in FIG. 7.

The switch described herein provides a locking function totally within the housing of the switch, the elements of such function not being visibly apparent for potential defeating of the lock. The particular arrangement of elements to provide the locking function permits a lock-off function to be applied to a center off, double throw rocker switch. Although the switch has been shown and described in a preferred embodiment, it is to be understood that it is capable of various modifications without departing from the scope of the appended claims.

I claim:

1. A locking rocker switch comprising, in combination:

an insulating housing defining an interior chamber and having an access opening thereto;

a rocker actuator pivotally mounted to said housing in said opening about an axis;

switch contacts in said housing actuated by pivotal movement of said actuator;

abutments defined within said chamber below said access opening at opposite sides of said axis of said pivotally mounted actuator; and a lock slidably mounted on said actuator and spring biased to a first position and slidable against said bias to a second position, said lock having a plurality of feet depending therefrom and extending into said chamber, each foot being respectively aligned with a corresponding abutment in said first position of said lock blocking pivotal movement of said actuator, said feet being clear of all of said abutments in said second position of said lock permitting pivotal movement of said actuator.

2. A locking rocker switch as defined in claim 1 wherein said actuator is selectively movable clockwise or counterclockwise when said lock is in said second position.

3. A locking rocker switch as defined in claim 1 wherein said switch contacts comprise a common center contact pivotally supporting a movable contactor thereon, distal ends of said movable contactor being spaced from associated stationary contacts, and said actuator is selectively movable clockwise or counterclockwise when said lock is in said second position.

4. A locking rocker switch as defined in claim 3 wherein said lock has an aperture in each said depending leg and said actuator has outwardly directed lateral tabs, said lock being snap-fit attached to said actuator by deflecting said legs outward over said tabs, causing said apertures to align with and receive said tabs therein.

5. A locking rocker switch as defined in claim 4 wherein said apertures are longer than said tabs in a direction transverse to said axis, thereby defining said first and second positions of said sliding movement of said lock.

6. A locking rocker switch as defined in claim 1 wherein said lock comprises legs depending from opposite sides thereof, said feet depending from distal ends of said legs, and said lock straddles said actuator with said legs depending into said chamber within said opening.

7. A locking rocker switch as defined in claim 6 wherein said actuator is pivotally mounted in side walls of said chamber adjacent said legs and said abutments project inwardly from at least one of said side walls.

8. A locking rocker switch as defined in claim 7 wherein at least one of said legs adjacent said at least one of said side walls has a pair of said feet depending therefrom, individual feet of said pair of feet being disposed on opposite sides of said axis.

9. A locking rocker switch as defined in claim 8 wherein said lock is slidable transversely of said axis, said feet being radially disaligned with said abutments in said second position.

* * * * *